United States Patent [19]

Klem

Best Available Copy

[11] 4,297,915

[45] Nov. 3, 1981

[54] POSITIVE LEVER LOCATION MAINTENANCE TRAP

[75] Inventor: John E. Klem, Waukegan, Ill.

[73] Assignee: International Harvester Company, Chicago, Ill.

[21] Appl. No.: 148,648

[22] Filed: May 12, 1980

[51] Int. Cl.[3] ..... G05G 5/06

[52] U.S. Cl. ..... 74/532; 74/475; 70/199

[58] Field of Search ..... 74/475, 526, 527, 532; 70/192, 193, 199, 202, 238

[56] References Cited

U.S. PATENT DOCUMENTS 1,395,966 11/1921 McManus ..... 70/199

FOREIGN PATENT DOCUMENTS 2610205 9/1976 Fed. Rep. of Germany ..... 74/527

466676 12/1913 France ..... 74/475

*Primary Examiner*—Kenneth Dorner

*Attorney, Agent, or Firm*—Douglas W. Rudy; F. David AuBuchon

[57] ABSTRACT

A control lever 10 is restrained in a neutral position through the interaction of a perforated hinged plate 24 with a horizontal rod 16 extending from said control lever 10. The hinged plate 24 is provided with a spring 44 to urge the plate 24 into engagement with the upwardly extending end portion 20 of the rod 16 attached to the control lever 10. The spring 44 also urges the hinged plate 24 into a disengaged over-center position when the lever trap is in a disengaged mode.

5 Claims, 5 Drawing Figures

FIG. 1
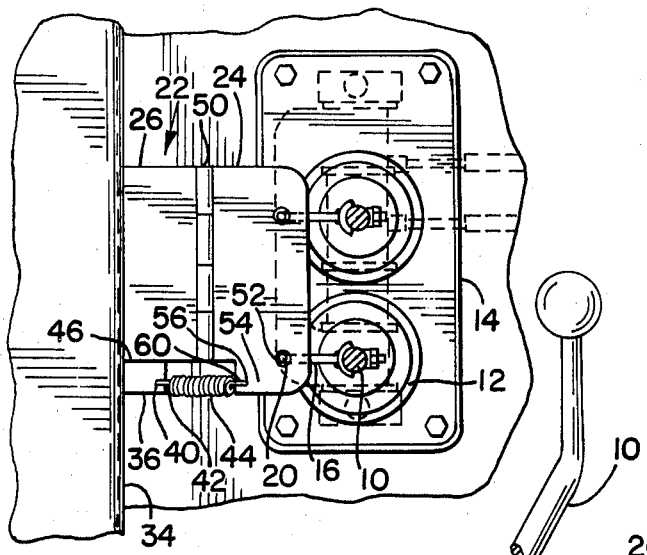
FIG. 4
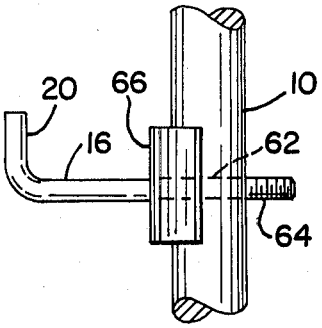
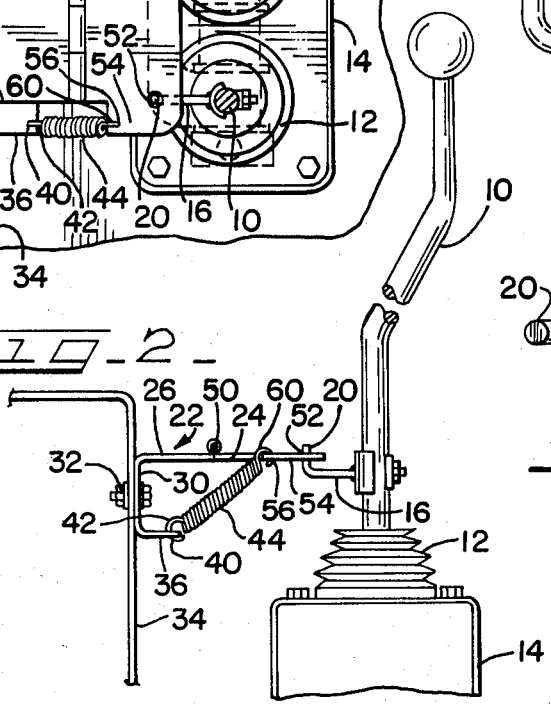
FIG. 2
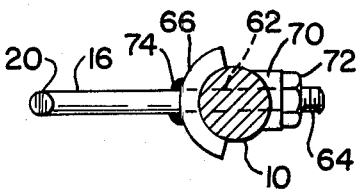
FIG. 5
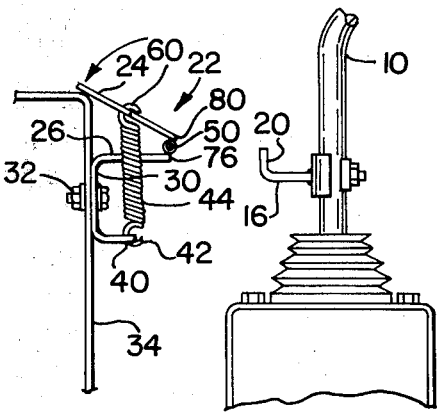
FIG. 3

POSITIVE LEVER LOCATION MAINTENANCE TRAP

BACKGROUND OF THE INVENTION

This device is a locking device to hold one or a plurality of control levers in a static position. A spring actuated over center hinged plate is provided with apertures that may constrain the movement of the control lever through interaction with a projecting rod mounted on the control lever.

The prior art includes devices that restrain the movement of control levers. The most obvious types of devices utilize spring loaded detents that may be overridden by an operator when the detented lever is displaced with a certain degree of force. Shift levers of automobiles often are guided by a shift gate that assists in proper gear selection. These gates have been designed in certain cases to positively lock out given gears that are not engaged during normal driving. Reverse gear would be an example.

Shift levers have also been designed where a latch mechanism has been incorporated into the lever that would be fingertip controlled to release the lever. This also prevented inadvertent gear shifts.

The closest prior art known by the Applicant involves a transmission lever lockout device where a spring biased plate having a slot formed in the active portion, so as to make a U-shaped plate, can be flipped over to engage the shift lever and prevent relative fore and aft displacement.

The device does not positively prevent the movement of the lever as the lever would still be free to move horizontally through the slot in the plate.

In off-highway construction equipment such as an articulated four wheel drive loader having a boom mounted hydraulically operated scoop at the front end thereof it is occasionally necessary to maintain the levers controlling the scoop hydraulics in a neutral position. This is oftentimes necessary when the vehicle is being serviced and the sccop would be at rest on the ground. With the levers restrained in neutral an accidental jostling of them such that the scoop is moved may be prevented. This invention is directed at providing a positive lever location maintenance trap that serves this purpose.

It is also occasionally desirable to maintain the hydraulic scoop control in neutral when the vehicle is being driven, towed on the road or towed on a trailer. Thus a device, such as this invention, that would not be disengageable by vibration is desirable. The spring of this apparatus will tend to keep the device engaged in situations where normal vibrations may rattle a lever without the device out of a neutral position.

The instant invention includes a plurality of advantages that make it more desirable than the prior art known to the Applicant. Among these advantages is that the device will positively lock the control lever in a neutral position relative to the lever's path of normal travel assuming the path is parallel to the horizontal rod.

Another advantage is that the horizontal rod portion is removable from the control lever. This allows the control lever dust boot to be taken off and replaced over the handle of the control lever rather than necessitating the complete removal of the lever to replace the boot or gain access to the lever fulcrum cover box.

Another advantae of this device is that the spring tension will be predictable in both the engaged and disengaged positions. When engaged the hinged portion is prevented from going beyond a horizontal deployment. Also, when disengaged the hinged portion is prevented from going beyond a predetermined point. As both these engaged and disengaged positions are predeterminable then only a spring with appropriate characteristics, primarily length and tension can be selected. Spring selection would yield a spring that would always be under some tension thus preventing it from needing a positive attachment device to ensure it stays engageable.

Another advantage is that the structure of the horizontal rod includes an arcuate rod stop that functions to locate the horizontal rod and also to provide increased strength in the control lever in the area where the control lever has been drilled through to except the horizontal rod.

Another advantage is that this invention can be retrofitted to unequipped machines with only minimal modifications of the machine.

The device is inexpensive to manufacture yet capable of being sturdily constructed to provide a control lever location maintenance trap that will maintain the lever in a predetermined location.

SUMMARY OF THE INVENTION

A control lever location maintenance trap is made up of two basic elements. A hinged plate having at least a single aperture in a movable leaf is pivotable to a horizontal position in alignment with a stationary leaf of the hinged plate. The stationary leaf is integral with a mounting plate which is perforated to accept attaching fasteners. A projecting tab is integral with and extends outwardly from the mounting plate.

The second element is a horizontal rod having an upwardly extending forward portion and a threaded aft portion. An arcuate rod stop is affixed to the rod to locate it on the control lever to be restrained.

BRIEF DESCRIPTION OF THE DRAWING FIGURES

The objects and advantages of this invention will be understood as the specification is read and the drawing figures are referred to wherein:

FIG. 1 presents a top view of the invention as it would be mounted in a typical embodiment;

FIG. 2 presents an elevation view of the invention shown in FIG. 1;

FIG. 3 presents a portion of the side elevation view of FIG. 2 showing the invention in an unlatched mode;

FIG. 4 shows a portion of a control lever and a rod of this invention; and

FIG. 5 is a top view of the rod of FIG. 4 as a completed assembly.

DETAILED DESCRIPTION OF THE INVENTION

A comprehensive overview of the invention can be seen by examining FIGS. 1 and 2. In FIG. 2 a control lever 10 is shown projecting through a dust boot 12 into a lever fulcrum cover box 14 in a conventional fashion. In a specific embodiment of the invention the control lever 10 would be a hydraulic control lever for effecting adjustment of boom and bucket cylinders on the front of a "front end loader". Usually two or more levers are provided (two shown in FIG. 1). The levers in this invention typically move in a vertical fore and aft plane.

Attached to the control lever 10 is a horizontal, rod 16 horizontal with a horizontal upwardly extending end portion 20.

Another basic element of this invention is the hinged plate generally 22 having a movaable leaf 24 and a stationary leaf 26 horizontally disposed and aligned with the movable leaf 24. The stationary leaf 26 is integral with a mounting plate 30 which may be provided with mounting fasteners such as 32 to allow mounting of the positive lever location maintenance trap to an adjacent surface such as structural panel 34. Structural panel 34 will extend vertically above the hinged plate generally 22. Extending from the mounting plate 30 is a projecting tab 36 which is provided with an aperture 40 for accepting a first mounting eye 42 of a coil spring 44. The projecting tab 36 is located such that the aperture 40 is outboard of a vertical plane from the edge 46 of the stationary leaf 26 at least a distance equal to the radius of the spring 44 in order that the spring may be extended vertically above the hinged plate generally 22 when the movable leaf 24 is rotated around hinge pin 50 to the position shown in FIG. 3.

The movable leaf 24 is provided with at least one aperture such as 52 to accommodate the upwardly extending end portion 20 of the rod 16. The movable leaf 24 also includes an appendage 54 which is provided with an aperture 56 to accept a second mounting eye 60 of the spring 44. The apertures 40 and 56 in the projecting tab 36 and appendage 54 respectively are generally aligned in the same vertical plane so that the spring 44 will not contact the edge 46 of the stationary leaf 26 or the adjacent end of the hinge pin 50.

FIGS. 4 and 5 clearly show the rod 16 and the upwardly extending end portion of the rod and the rod's relationship with the control lever 10. The control lever 10 is provided with a bore 62 transverse to the longitudinal axis thereof through which a threaded portion 64 of the rod is inserted. In a preferred embodiment an arcuate rod stop 66 is provided on the rod 16 between the upwardly extending end portion and the threaded portion in a non-movable manner and then the rod is projected through the bore 62 and a compatible spacer/washer 70 and a nut 72 are tightened on the threaded end 64 to hold the rod in place. The arcuate rod stop 66 is an arcuate section having a major longitudinal axis aligned with the longitudinal axis of the control lever 10. Typically the arcuate rod stop 66 would have a small weld 74 to ensure that the rod 16 will not turn in the bore and also to prevent the end 20 from projecting upwardly. The arcuate rod stop 66 is important as it not only prevents movement of the rod 16 but it also adds strength to the control lever 10 which may be weakened in the area of the bore 62 thus minimizing the adverse effect drilling of the bore would have on the lever.

FIG. 3 shows the movable leaf 24 in a disengaged position and resting against structural panel 34. It is important to note that the movable leaf is prevented from going all the way down to a horizontal position as this prevents the spring 44 from becoming loose enough to be vibrated out of its attaching apertures. Since the movable leaf 24 is always longer, that is, from the hinge pin to the parallel edge surface, than the stationary leaf 26 as long as a portion of the panel to which the hinge trap is mounted extends sufficiently above the plane of the stationary leaf, the movable leaf will always contact it before tension on the spring 44 is too weak to hold the spring in place.

The horizontal limit of the movable leaf is also important when the movable leaf is engaged with the rod 16 as without a limit the movable leaf would pivot around the hinge pin too far enabling spring tension to be decreased and the spring to vibrate out of its attachment apertures. The design of the hinged plate generally 22 prevents the movable leaf from going below horizontal. Both the stationary leaf 26 and the variable leaf 24 are provided with sufficiently wide contact surfaces 76 and 80 respectively (best seen in FIG. 3) that will contact each other when the movable leaf is horizontal. Notice that in FIG. 2 the movable leaf is horizontal and the upwardly extending portion of the rod 16 has only a part of its length projecting through aperture 52. The provision not allowing the movable leaf to go below horizontal is functionally most important when the leaf has not trapped the rod 16, i.e. the control lever is not in neutral but is pulled back away from structural panel 34. If there was no horizontal stop then the movable leaf would be drawn downwardly toward the projecting tab 36 and the spring 44 could shake out of the attachment apertures as it would not be under tension.

To operate the positive lever location maintenance trap the vehicle operator will position the control lever 10 in neutral and simply flip the movable leaf toward the lever. The leaf will go over center and the spring tension will hold it horizontal. The upwardly extending end of the rod 16 will be trapped in the aperture 52 of the movable leaf thus preventing movement in the vertical fore and aft plane of the lever.

In FIG. 1 two control levers are shown and it can be seen how one movable leaf can accommodate more than one lever. It is also contemplated that a plurality of apertures could be provided in the movable leaf of the hinge plate in order that the control lever could be held in other displacement positions as necessary. For instance it may be desirable to hold the rod all the way forward and thus an aperture would be provided closer to the hinge point of the hinged plate.

Another alternative embodiment incorporates the use of elongated apertures in place of the round aperture such as 52 thereby allowing some leeway in the actual position of neutral. Thus it can be seen that there has been provided a positive lever location maintenance trap that satisfies the objects and aims set forth in the specification. It is to be understood that nuances of design based upon the inventor's invention have been considered and minor deviation from the embodiment set forth in the specification should not be construed as unique devices.

What is claimed is:

1. In a vehicle having a hydraulic working circuit and a control for adjusting flow through said circuit, the improvement comprising:

a control lever operable in a fore and aft vertical plane having a bore provided therethrough transverse to the longitudinal axis of said control lever;

a rod having an upwardly extending end portion positioned into said bore of said control lever and projecting forwardly from said control lever;

a hinged plate having a mounting plate surface and a stationary leaf extending from said mounting plate surface toward said control lever, said stationary leaf having an edge, a movable leaf connected to said stationary leaf through a hinged pin on said stationary leaf, said movable leaf having an aperture therethrough of a diameter large enough to accommodate said rod and an appendage provided with an aperture therethrough;

a projecting tab extending forward from said mounting plate surface toward said control lever, said projecting tab having an aperture located through said tab and being outboard of a vertical plane corresponding to said edge of said stationary leaf, said aperture of said projecting tab aligned in the same vertical plane as said aperture in said appendage of said movable leaf;

a spring having a first mounting eye connected through said aperture of said projecting tab and a second mounting eye connected through said aperture of said appendage of said movable leaf;

a contact surface integral with said stationary leaf adjacent said hinged pin on a lower side thereof and a second contact surface integral with said movable leaf adjacent said hinged pin on the lower side thereof, said first and second contact surfaces in contact with each other when said movable leaf is urged to a position whereby said rod is engaged in said aperture of said movable leaf.

2. The invention in accordance with claim 1 wherein said rod comprises:

a horizontal rod having an upwardly extending end portion at one end thereof and a threaded portion at the other end thereof;

an arcuate rod stop having an aperture therethrough for accommodating said rod, said arcuate rod stop positioned on said rod between said upwardly extending end portion and said threaded portion and having its longitudinal axis aligned with said longitudinal axis of said control lever;

a spacer/washer located on said threaded end portion of said rod;

a nut threaded on said threaded end portion of said rod to maintain said spacer washer on said rod and to maintain said arcuate rod stop against said control lever.

3. The invention in accordance with claim 1 wherein said hinged plate mounting plate surface is provided with a mounting fastener for mounting said hinged plate to a structural panel having a surface extending vertically above said hinged plate stationary leaf whereby said movable leaf will be limited in arcuate travel around said hinge pin.

4. The invention in accordance with claim 1 wherein said movable leaf will be horizontal when said upwardly extending end portion of said rod projects into said aperture of said movable leaf.

5. The invention in accordance with claim 1 wherein said movable leaf has a horizontal length greater than the horizontal length of said stationary leaf.

* * * * *